United States Patent [19]

Maron

[11] 4,303,703

[45] Dec. 1, 1981

[54] METHOD OF MAKING AN IMPROVED NATURAL-TEXTURED CEILING TILE

[75] Inventor: Donald E. Maron, Lancaster, Pa.

[73] Assignee: Armstrong World Industries, Lancaster, Pa.

[21] Appl. No.: 170,649

[22] Filed: Jul. 21, 1980

[51] Int. Cl.[3] ..... B05D 3/12

[52] U.S. Cl. ..... 427/272; 51/311; 51/312; 427/289

[58] Field of Search ..... 51/311, 312; 427/290, 427/291, 292, 289, 272

[56] References Cited

U.S. PATENT DOCUMENTS 3,473,941 10/1969 Hemphill ..... 51/311 X 4,093,754 6/1978 Parsons ..... 427/272 X

*Primary Examiner*—Evan K. Lawrence

[57] ABSTRACT

A method of treating a fibrous panel having natural fissures in order to enhance and enlarge the natural fissures. The upper surface only of the fissured material is coated with a hardenable liquid abrasive resist which is subsequently hardened. This leaves the fissured areas unprotected by the resistant. The surface coated by the resist is abrasively treated to erode the fissures to enhance them while maintaining the planar surface treated with the resist unaffected by the abrasive treatment step.

2 Claims, 1 Drawing Figure

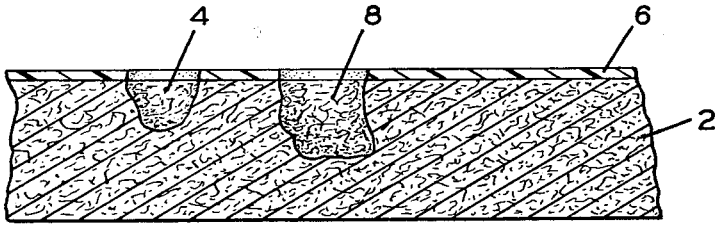
4
8
6
2

METHOD OF MAKING AN IMPROVED NATURAL-TEXTURED CEILING TILE

BACKGROUND OF THE INVENTION

The invention is directed to a method of making a ceiling board and more particularly, to a technique for abrasively treating a ceiling board to effect a pattern in the surface of the ceiling board.

DESCRIPTION OF THE PRIOR ART

U.S. Pat. No. 3,473,941 is directed to a technique for abrasively treating the surface of the ceiling board to provide it with a design.

U.S. Pat. No. 3,117,403 is directed to another technique for abrasively treating the surface of a ceiling board to provide it with a pattern.

U.S. Pat. Nos. 3,837,881 and 4,093,754 are directed to techniques for abrasively treating surfaces to provide them with designs.

U.S. Pat. Nos. 2,717,538 and 3,013,626 are patents directed to techniques for providing fissures in a ceiling board.

SUMMARY OF THE INVENTION

The invention is directed to a method of treating a fibrous panel having at least one planar surface containing therein natural fissures. The surface of the fibrous panel is coated with a hardenable liquid abrasive resist which will extend at least partly into the surface of the panel in contacting relationship with the fibers of the panel. The resist only coats the planar surface of the panel and is not applied to the fissures of the panel. After the liquid abrasive resist is dried to harden it, an abrasive treatment is carried out on the planar surface to erode the fissures to enlarge them while maintaining the planar surface treated with the resist unaffected by the erosion treatment step.

BRIEF DESCRIPTION OF THE DRAWING

The FIGURE is a cross-sectional view of a ceiling board treated or to be treated by the claimed method.

DESCRIPTION OF THE PREFERRED EMBODIMENT

In the drawing there is shown a fibrous ceiling board 2 such as is conventional in the art. It is provided with a series of fissures or depressions 4. These fissures are indentations in the surface of the board and are naturally or mechanically randomly positioned indentations throughout the surface of the board. The fissures have side walls extending below the surface of the fibrous panel. The planar upper surface of the panel is provided with a resist coating 6 which covers only the planar surface of the panel and no resist is applied to the interior or the side walls of the fissure. After an abrasive treating operation, the fissure now takes on the appearance of fissure 8 with an enlarged and enhanced appearance.

A conventional fissured ceiling board may be manufactured by either the technique of U.S. Pat. No. 2,717,538 wherein the fissures are formed naturally, or the fissures may be formed mechanically as shown in U.S. Pat. No. 3,013,626. The invention is preferably used with the naturally formed fissures. The planar surface of the ceiling board formed by the above two mentioned patents will then be provided with a coating of a resist material such as that described in U.S. Pat. No. 3,473,941. This coating may be either screen printed or roll coated only on the raised planar surface of the ceiling board containing the fissures. This then provides a coating on the board surface such as that shown in the drawing where resist coating 6 covers only the planar upper surfaces of the board 2. After the resist coating has dried, the board is abrasively treated in the manner taught in U.S. Pat. No. 3,473,941. This erosion treatment operation will erode away the side walls and the bottom of the fissures to enlarge and enhance the fissures and provide a product with deeply eroded fissures. After the erosion treatment operation, the board may be finished in a conventional manner by being provided with appropriate paint coatings on the planar surface thereof.

What is claimed is:

1. A method of treating a fibrous panel having at least one planar surface containing therein fissures, the method comprising the steps of:

(a) roll coating said at least one planar surface of the fibrous panel with a hardenable liquid abrasive resist which will extend at least partly into the surface of said panel in contacting relationship with the fibers of said panel, said resist only coating all of said above planar surface of the panel and not being applied into the fissures of the panel;

(b) drying the liquid abrasive resist to harden it; and (c) abrasively treating said above planar surface to erode the fissures to enlarge them while maintaining said above planar surface treated with said resist unaffected by the erosion treatment step.

2. The method according to claim 1 wherein the fissures are indentations in the surface of the panel and are randomly positioned indentations throughout the surface of the board, said fissures having side walls extending below the surface of the fibrous panel.

* * * * *